US006173129B1

(12) United States Patent
Kimizuka

(10) Patent No.: US 6,173,129 B1
(45) Date of Patent: Jan. 9, 2001

(54) IMAGE RECORDING APPARATUS CAPABLE OF DETECTING LIFE OF A REPLACEABLE CARTRIDGE

(75) Inventor: Junichi Kimizuka, Yokohama (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/247,051

(22) Filed: Feb. 9, 1999

(30) Foreign Application Priority Data

Feb. 16, 1998 (JP) ..... 10-033140

(51) Int. Cl.[7] ..... G03G 15/00
(52) U.S. Cl. ..... 399/25; 399/43; 399/89
(58) Field of Search ..... 399/25, 26, 13, 399/43, 24, 88, 89

(56) References Cited

U.S. PATENT DOCUMENTS 5,066,978 * 11/1991 Watarai et al. ..... 399/24
5,926,665 * 7/1999 Suzuki ..... 399/25

FOREIGN PATENT DOCUMENTS 8-160680 6/1999 (JP) .

* cited by examiner

*Primary Examiner*—William J. Royer
(74) *Attorney, Agent, or Firm*—Fitzpatrick, Cella, Harper & Scinto

(57) ABSTRACT

An image recording apparatus operates a counter acting as a print timer in a printing operation. In a case where a counted value reaches a predetermined value, the image recording apparatus sets a waiting state, stops power supply from a high voltage power supply unit according to a predetermined sequence, starts to operate a nonvolatile memory in a cartridge according to a predetermined procedure, reads data from the memory, adds the read data to the counted value of the print timer, and then writes an added result.

27 Claims, 6 Drawing Sheets

IMAGE RECORDING APPARATUS CAPABLE OF DETECTING LIFE OF A REPLACEABLE CARTRIDGE

BACKGROUND OF THE INVENTION

1. Field of the Invention

The present invention relates to an image recording apparatus which accesses a memory storing data used in detecting a life of a replaceable cartridge.

2. Related Background Art

Conventionally, an image recording apparatus of an electrostatic photographic system using a process cartridge has been known, and a structure of the apparatus has been described in, e.g., Japanese Patent Application Laid-Open No. 8-160680. The process cartridge is integrally composed of a photosensitive drum, a charger, a development unit, a cleaner and the like, and is detachably mounted on the image recording apparatus. The process cartridge involves a nonvolatile memory unit to store the sum total of rotating times of the photosensitive drum. The contents in the nonvolatile memory unit are used to detect whether or not the life of the photosensitive drum terminates.

As described above, the nonvolatile memory unit is arranged in the vicinity of the charger, the development unit, a transfer roller and the like. Therefore, in a case where an electromagnetic noise is generated from a high voltage power supply unit in an image formation apparatus due to, e.g., a discharge (leak) of high voltage applied to the charger, the electromagnetic noise is superimposed on read and write signals of the nonvolatile memory unit. As a result, there is some fear that the stored contents change.

Therefore, in order to prevent that the electromagnetic noise is superimposed on the read and write signals of the nonvolatile memory unit, it is thought that read and write operations of the nonvolatile memory unit are to be performed only when the image recording apparatus is in a standby state. In other words, it is through that the operations are to be performed only when the high voltage is not applied. However, if doing so, the read and write operations of the nonvolatile memory unit can not be performed when the image recording apparatus continuously performs the image recording. For this reason, if such a condition as the read and write operations can not be performed continues for long, the rotating time (period) of the photosensitive drum during this condition is not added to the sum of rotating time (period) previously stored in the nonvolatile memory unit. Thus, if a power supply unit is shut down before the sum of actual rotating time of the photosensitive drum is written into the memory unit, the stored contents are seriously different from the sum of actual rotating time.

Even if the read and write operations of the nonvolatile memory unit are performed while applying of the high voltage in continuous image recording is being stopped, there is some fear that an electric charge transfers onto a paper sheet being moved inside the image recording apparatus and thus discharge occurs on the moving sheet. Due to this discharge, there is some fear that the electromagnetic noise is generated, the generated noise is superimposed on the read and write signals of the nonvolatile memory unit, and thus the data changes by such the superimposed noise.

SUMMARY OF THE INVENTION

An object of the present invention is to provide an image recording apparatus and a control method thereof which can solve the above-mentioned problems.

Another object of the present invention is to provide an image recording apparatus and a control method thereof which can prevent data change in a nonvolatile memory unit which stores data used to detect a life of a replaceable element such as a photosensitive drum or the like.

Still another object of the present invention is to provide an image recording apparatus and a control method thereof which can accurately write data into a memory even if long-time continuous print is designated.

Other objects of the present invention will become apparent from the following description based on the attached drawings and the appended claims.

DETAILED DESCRIPTION OF PREFERRED EMBODIMENTS

Hereinafter, the embodiments of the present invention will be explained in detail with reference to the accompanying drawings.

<First Embodiment>

Figure 1:
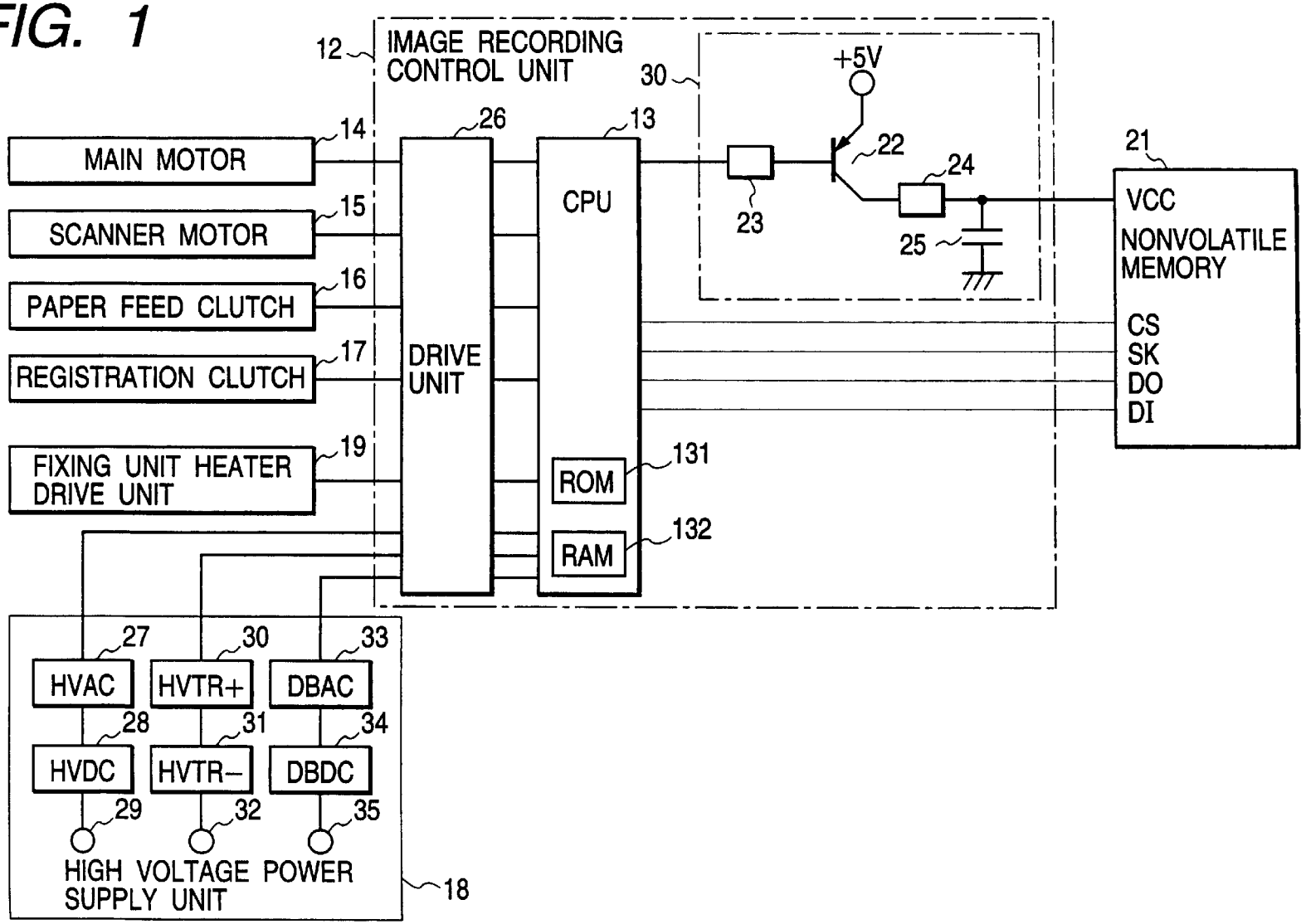
FIG. 1 is a block diagram showing a first embodiment of the present invention.
Figure 2:
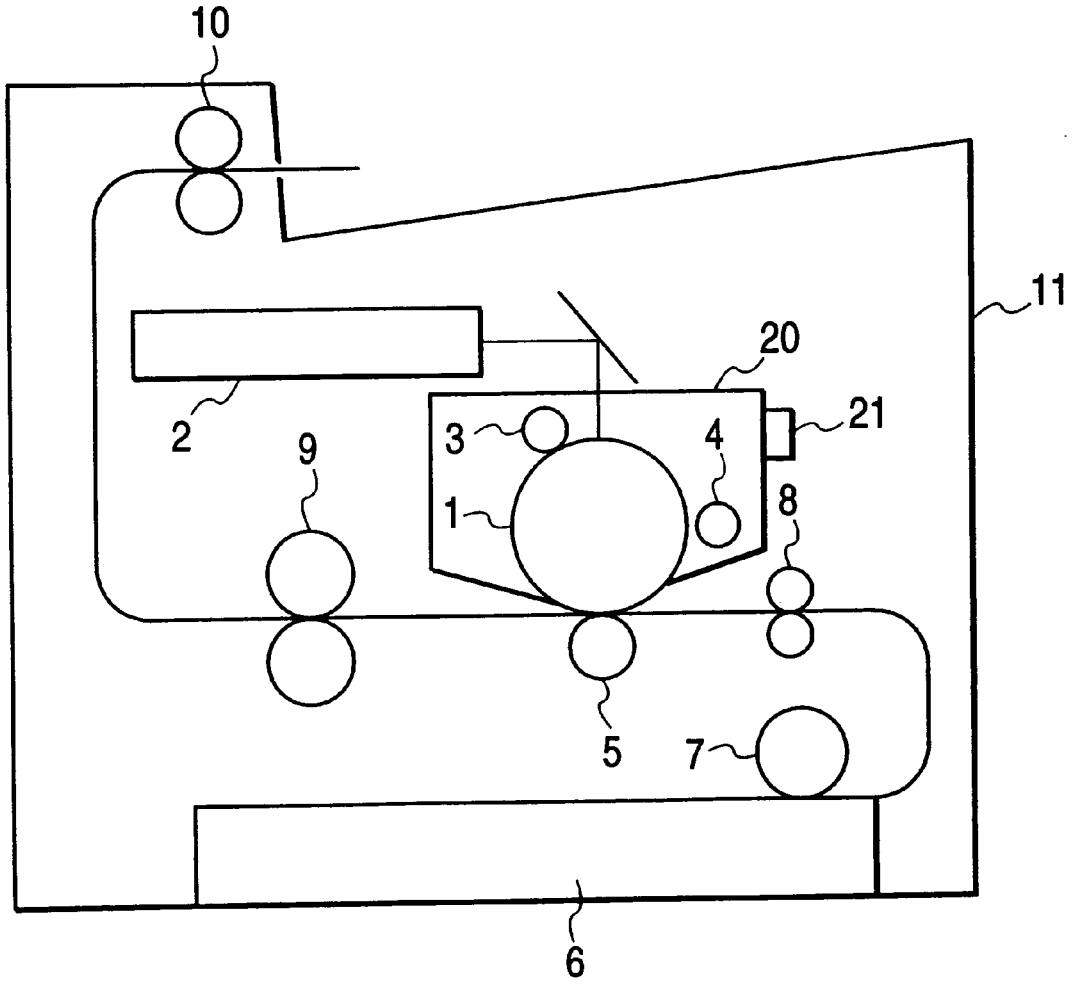
FIG. 2 is a cross-sectional view showing a structure of an image recording apparatus shown in FIG.

FIG. 1 is a block diagram showing an image recording apparatus of an electrophotographic system to which the present invention is applicable, and FIG. 2 is a sectional view showing a structure thereof. In FIG. 2, numeral 6 denotes a paper feed cassette which holds therein recording paper sheets. Numeral 7 denotes a paper feed roller which picks up the sheet one by one from the cassette 6.

Numeral 2 denotes a laser scanner unit which performs scanning by a laser beam modulated based on an inputted image signal. Numeral 20 denotes a process cartridge which is detachable from the image recording apparatus. The cartridge 20 involves a photosensitive drum 1, a charger roller 3 and a development roller 4. Further, a nonvolatile memory 21 is mounted on an outer surface of the cartridge 20. The photosensitive drum 1 is exposed and scanned by the laser beam from the laser scanner unit 2, and a latent image is formed thereon. The charger roller 3 uniformly charges the photosensitive drum 1. The development roller 4 develops the latent image on the photosensitive drum 1 to form a toner image. The process cartridge 20 further involves a toner hopper (not shown) for stocking toner and a cleaner (not shown) for collecting residual toner on the drum 1.

As the nonvolatile memory 21, for example, a CMOS (complementary metal-oxide-semiconductor) nonvolatile memory such as "S-29XXOA series" produced by SEIKO Electronic Company can be used. The memory 21 is used to store the sum of rotating time (period) or the like of the photosensitive drum 1, and the stored contents can be maintained while a power supply unit in the image recording apparatus is OFF.

Numeral 8 denotes a pair of registration rollers (referred as registration roller hereinafter) which takes transfer timing of an image leading edge. Numeral 5 denotes a transfer roller which is used to transfer the toner image on the recording paper sheet fed by the roller 8. Numeral 9 denotes a fixing unit which is used to thermally apply pressure and then fix the toner image on the sheet. Numeral 10 denotes a pair of discharge rollers (to be referred as discharge roller hereinafter) which is used to discharge the sheet to which the fixing process has been completed, to an outward portion of a body 11 of the apparatus.

Subsequently, an image recording process will be explained. A surface of the photosensitive drum 1 is charged by the charger roller 3. Then, when the drum 1 is scanned by the laser beam generated from the laser scanner unit 2, the latent image is formed on the surface of the drum 1. The formed latent image is toner-developed by the development roller 4. The toner image obtained by the developing process is then transferred on the recording paper sheet fed by the registration roller 8, by the transfer roller 5. Subsequently, the toner image on the sheet is fixed by the fixing unit 9. After the toner image is fixed, the sheet is discharged to an external of the image recording apparatus 11 by the discharge roller 10.

Subsequently, the contents of FIG. 1 will be explained hereinafter. In FIG. 1, numeral 21 denotes the unit identical with that shown in FIG. 2. Numeral 12 denotes an image recording control unit which controls the image formation of the image recording apparatus 11 (FIG. 2). The image formation unit 12 has a CPU 13, a drive unit 26 and a power supply unit 30. In accordance with control programs stored in a ROM 131, the CPU 13 controls read and write operations of the nonvolatile memory 21, and controls power supply to the memory 21 through the power supply unit 30. Further, the CPU 13 controls driving of a main motor 14, a scanner motor 15, a paper feed clutch 16, a registration clutch 17 and a fixing unit heater drive unit 19, through the drive unit 26, and also controls each power supply unit in a high voltage power supply unit 18. A RAM 132 is used as a working area of the CPU 13.

The power supply unit 30 has a transistor 22 for controlling the power supply to the memory 21, a base resistor 23 of the transistor 22, a resistor 24 for limiting an input current to a capacitor 25, and the power maintenance capacitor 25 for guaranteeing the power supply to the memory 21 for a certain period of time when the power to the image recording apparatus is shut down.

The main motor 14 drives the photosensitive drum 1, the paper feed roller 7, the registration roller 8, other rollers, the fixing unit 9, and the like. The scanner motor 15 is involved in the laser scanner unit 2. The paper feed clutch 16 drives and controls the paper feed roller 7. The registration clutch 17 controls driving of the registration roller 8. The fixing unit heater drive unit 19 drives a heater in the fixing unit 9.

The high voltage power supply unit 18 supplies a high voltage to the charger roller 3, the development roller 4 and the transfer roller 5, and has a charger high voltage power supply unit for the photosensitive drum 1, a development high voltage power supply unit and a transfer high voltage power supply unit. An output of the charger high voltage power supply unit is obtained by superimposing an output of a high-voltage AC power supply unit (HVAC) 27 and an output of a high-voltage DC power supply unit (HVDC) 28, and is supplied to the charger roller 3 from a terminal 29. An output of the transfer high voltage power supply unit is obtained by switching outputs of a high-voltage DC plus power supply unit (HVTR+) 30 and a high-voltage DC minus power supply unit (HVTR−) 31, and is supplied to the transfer roller 5 from a terminal 32. An output of the development high voltage power supply unit is obtained by superimposing an output of a high-voltage AC power supply unit (DBAC) 33 and an output of a high-voltage DC power supply unit (DBDC) 34, and is supplied to the development roller 4 from a terminal 35.

Figure 3:
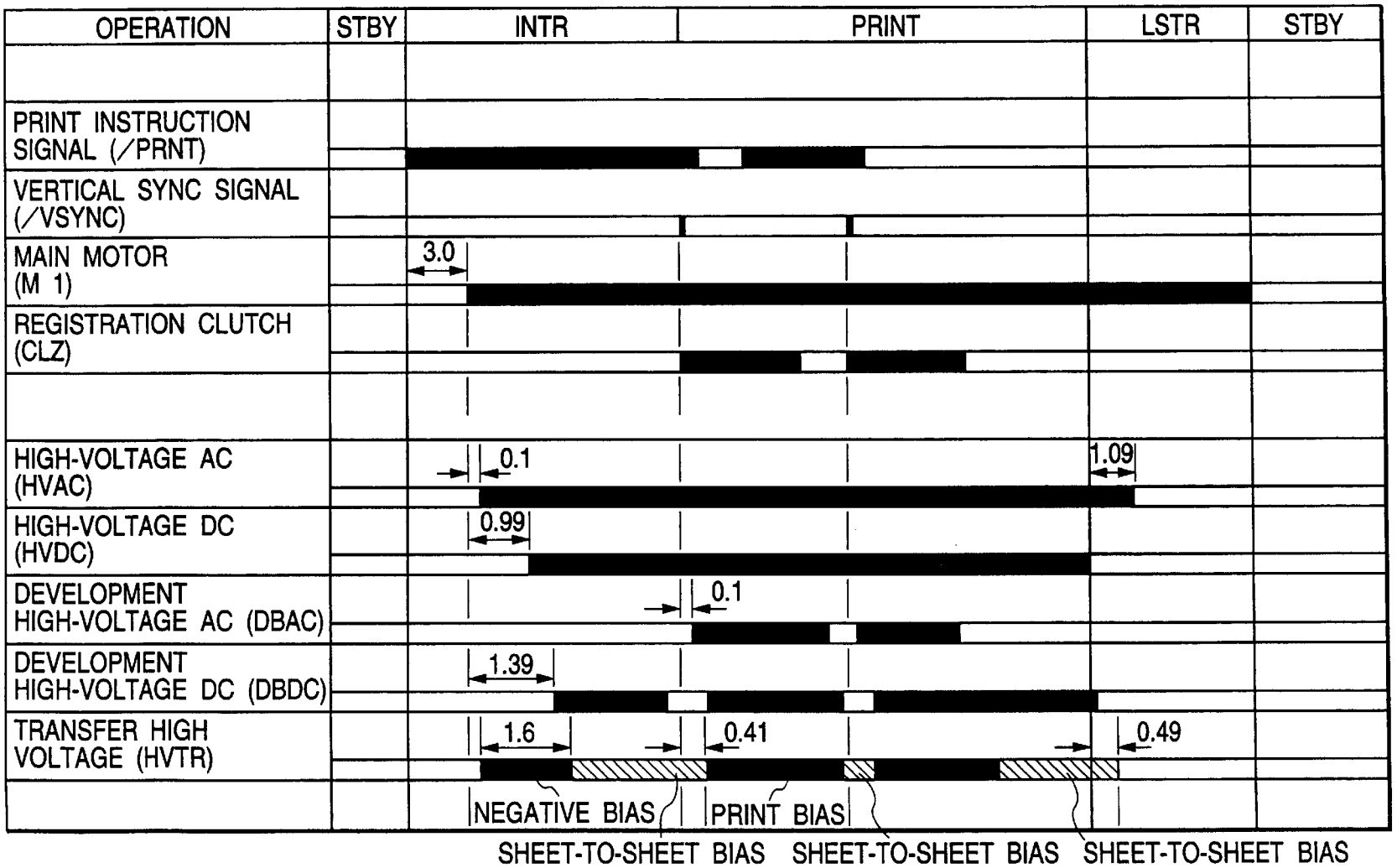
FIG. 3 is a timing chart showing an example of timing in a case where the image recording apparatus performs two-page recording.

Subsequently, a control procedure to apply the high voltage will be explained with reference to FIG. 3. FIG. 3 is a timing chart showing a case where the image recording apparatus 11 performs two-page recording (i.e., image recording of two sheets). In FIG. 3, each of solid black portions indicates a true state of each signal. If a print instruction signal (/PRNT signal) is supplied to the CPU 13 from an external unit in a standby state (STBY), the main motor 14 is driven by the drive unit 26. Then, initial rotation (INTR) is performed to uniformly charge the photosensitive drum 1. During this rotation (INTR), initially the HVAC 27 and the HVTR− 31 in the high voltage power supply unit 18 are turned on. Then, the HVDC 28 is turned on, and the DBDC 34 is also turned on. A transfer high voltage is halfway changed to a weak bias of the HVTR+. When the charging of the photosensitive drum 1 terminates, if a vertical sync signal (/VSYNC signal) is supplied to the CPU 13 from the external unit, the image recording apparatus 11 comes to be in a print state (PRINT). Then, the DBAC 33 in the unit 18 is turned on to start to develop the latent image on the photosensitive drum 1 by using the toner. The DBAC 33 and the DBDC 34 in the unit 18 respectively have OFF periods every one page. On the other hand, the HVAC 27 and the HVDC 28 in the unit 18 are left to be applied even in a page-to-page period. Print potential at the HVTR+ 30 in the unit 18 is applied to the transfer roller 5 only during a printing operation. After the recording of two pages terminates, the drum 1 is discharged and then starts to rotate (LSTR). In this state, the HVDC 28 and the DBDC 34 in the unit 18 are turned off, the HVTR+ 30 is turned off, and finally the HVAC 27 is turned off.

Figure 4:
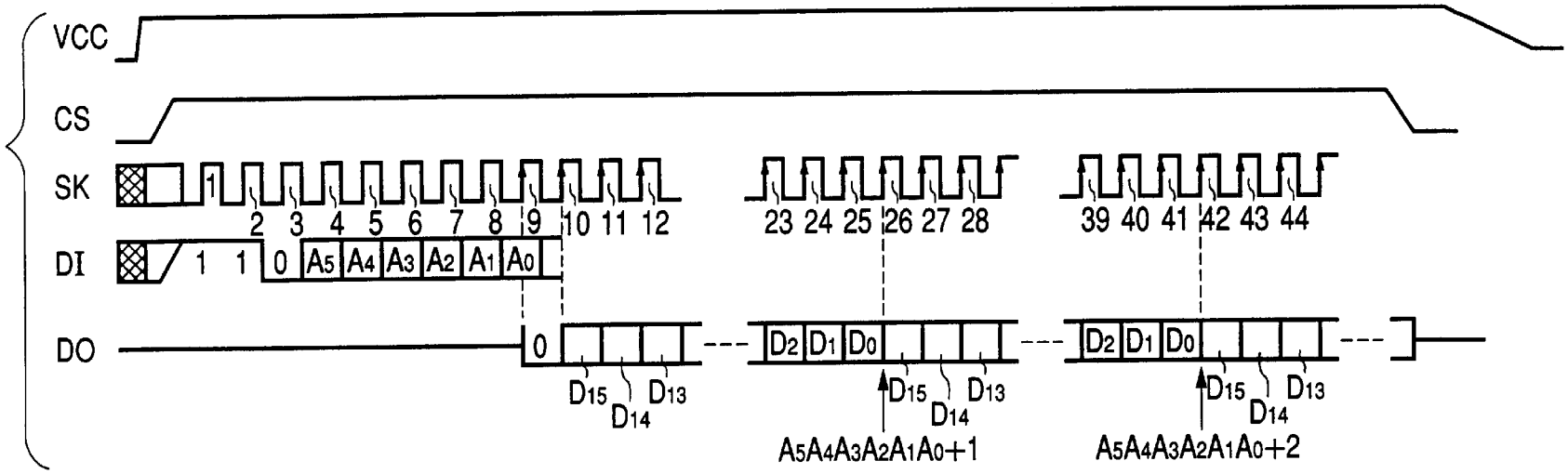
FIG. 4 is a timing chart showing an example of operation timing of a nonvolatile memory.

FIG. 4 shows an example of operation timing to access the nonvolatile memory 21. In this example, data reading from the memory 21 will be explained. A use time of the photosensitive drum 1 during a recording operation of the image recording apparatus 11 is counted (or clocked) by the CPU 13. When the apparatus 11 terminates the recording operation and comes to be in the standby state, data representing the sum of use time (period) of the drum 1 stored in the memory 21 is read, the count time is added to the read data, and an obtained result is rewritten into the memory 21. The data representing the sum of use time is used to detect a life of the cartridge.

Subsequently, an operation of the memory will be explained. Initially, the CPU 13 turns on the transistor 22 to apply a power voltage to a power supply terminal VCC of the nonvolatile memory 21. Then, the CPU 13 sets a chip selection signal CS in the memory 21 to be ON. In this state, the CPU 13 issues a command to a data input terminal D1. In this example, initial commands "1", "1" and "0" represent a read command, and subsequent commands "A5" to "A0" represent addresses to be read. If clocks SK are sequentially outputted from the CPU 13, 16-bit data (D15 to D0) at the designated address is outputted to a D0 terminal. If the clocks SK are successively supplied, data at a next address (+1) is outputted. Then, if the clocks SK are further supplied, data at a subsequent address (+2) is outputted. After the reading operation terminates, the chip selection signal CS is set to be OFF. Thereafter, the transistor 22 is turned off, and the power supply unit (terminal) VCC is also turned off.

Figure 5:
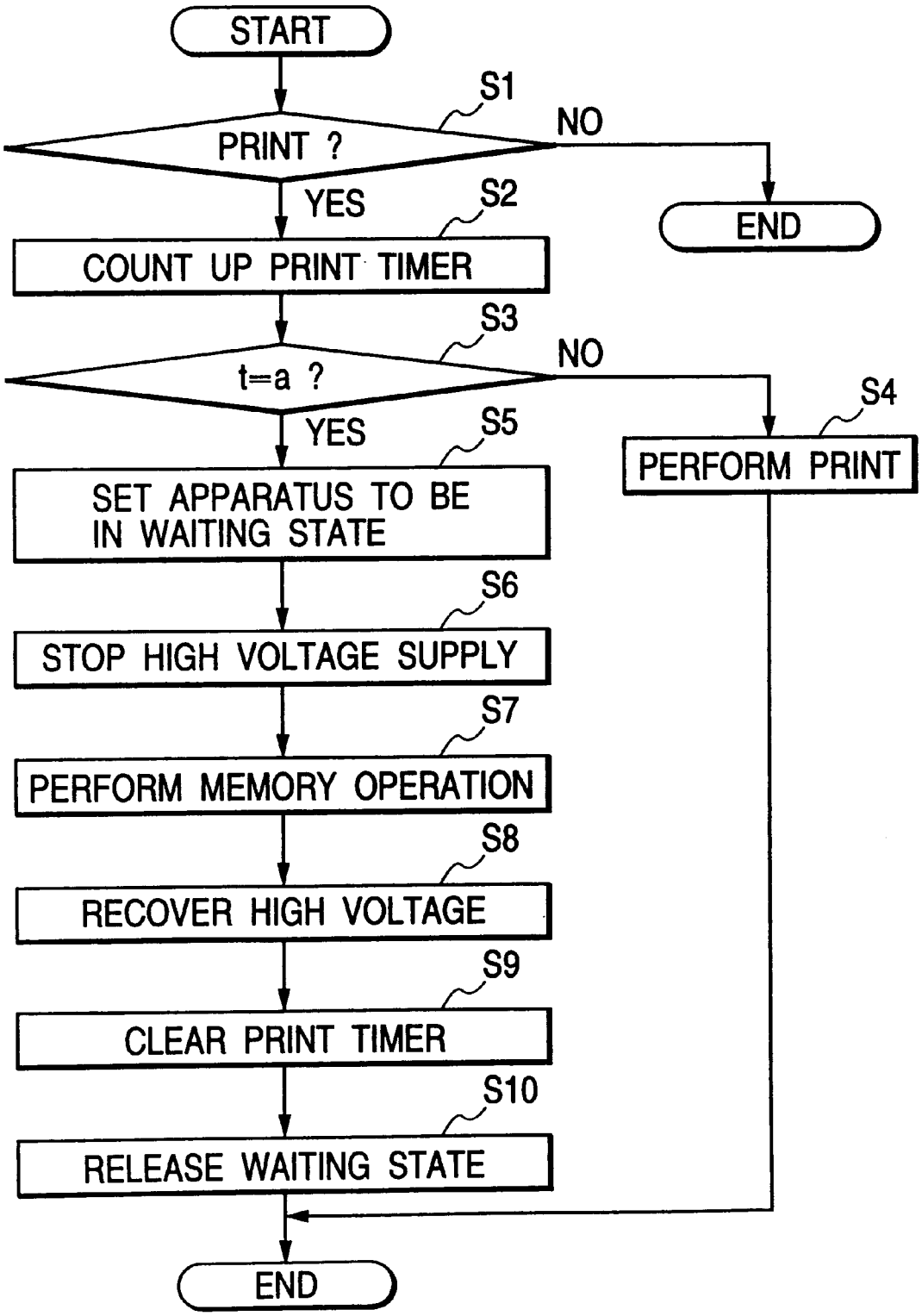
FIG. 5 is a flow chart showing an example of a control program in the first embodiment.

FIG. 5 is a flow chart showing an example of a control program stored in the ROM 131 of FIG. 1. This program is periodically and repeatedly executed. Initially, in a step S1, it is judged whether or not the apparatus is in a printing state. If judged that the apparatus is not in the printing state, the control terminates. On the other hand, if judged that the apparatus is in the printing state, a flow advances to a step S2. In the step S2, a print timer is counted up. Then, in a step S3, it is judged whether or not a count value t reaches a predetermined value. If judged that the count value does not reach the predetermined value, the printing operation is continued in a step S4, and then the control terminates. On the other hand, if judged that the count value reaches the predetermined value, it stops to feed a new recording paper sheet in a step S5. Further, after the recording on the sheet currently conveyed terminates, the apparatus is set to be in a waiting state. A status signal representing this state is supplied to a host computer connected to the recording apparatus. Then, in a step S6, a power supply from the high voltage power supply unit 18 is stopped according to the sequence as already explained in FIG. 3. Then, in a step S7, the nonvolatile memory 21 is operated according to the procedure as already explained in FIG. 4 to read data therefrom. The read data is added to the count value of the print timer, and the added result is then written. Also, data representing the number of printed sheets may be added to the sum of the number of printed sheets stored in the memory 21, and the added result may be written into the memory. In a step S8, after the read and write operations of the memory 21 terminate, the high voltage power is recovered according to the sequence as already explained in FIG. 3. If the high voltage power is recovered, the print timer is cleared in a step S9, and the waiting state of the apparatus is released in a step S10. Such a fact is informed to the host computer. Then, the apparatus is recovered to be in a continuous printing state. The data representing the sum of use time and the number of printed sheets stored in the memory 21 of the cartridge is used to detect the life of the cartridge.

As described above, in the present embodiment, it temporarily stops to apply the high voltage to an image formation apparatus in the continuous recording operation, as maintaining the operation of the main motor 14. Thus, the power is applied to the nonvolatile memory 21 mounted on the process cartridge 20. Moreover, the sum of use time (or the number of printed sheets) of the photosensitive drum 1 is read from the memory 21 while the applying of the high voltage is being stopped, the read sum is added to the use time (or the number of printed sheets) counted until the applying of the high voltage is stopped, and the added result is written into the memory 21 as a new sum of use time (or the number of printed sheets). Thus, it is possible to prevent that the electromagnetic noise due to a leak of the high voltage is generated. For this reason, it is possible to prevent that the stored contents change because the leaked noise is superimposed on the read and write data in the memory 21. In any case, since the main motor 14 is continuously operated while the high voltage is being applied, the recording paper sheets are still conveyed. However, even in this state, since merely it is externally viewed that the interval between the adjacent sheets becomes slightly wider, an actual problem almost never occurs.

In the steps S2 and S3, the state of the apparatus is shifted to the waiting state according to the count value of the print timer. However, the state of the apparatus may be shifted to the waiting state according to a parameter value in proportion to a print execution time such as the number of printed sheets or the like.

In the present embodiment, the example that the applying of the high voltage is stopped once. However, it is natural that, as a continuity time of the continuous recording becomes longer, the number of times to stop the applying of the high voltage becomes greater.

<Second Embodiment>

In the second embodiment, a procedure from a stop of power supply from the high voltage power supply unit 18 until data read and write operations of the nonvolatile memory 21 is different from that in the first embodiment.

Figure 6:
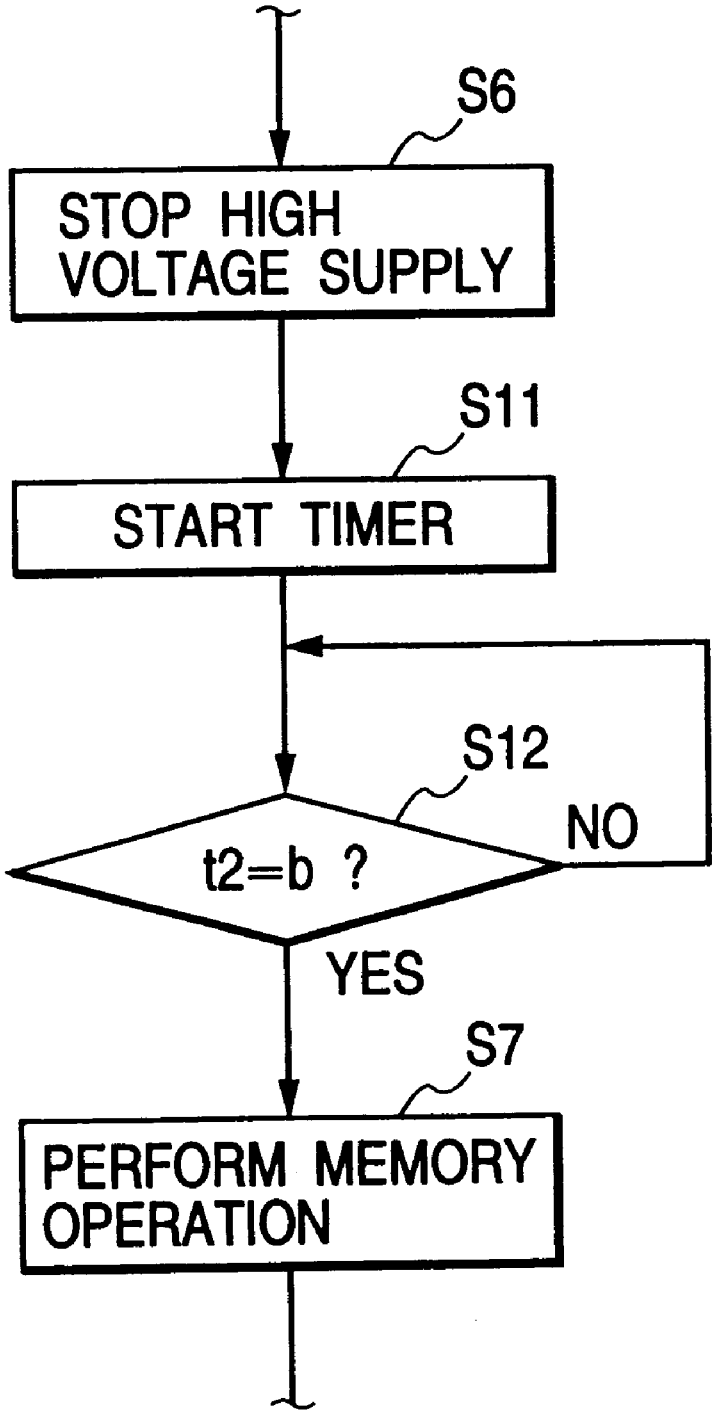
FIG. 6 is a flow chart showing an example of a control program in a second embodiment of the present invention.

In the present embodiment, FIG. 6 is a flow chart showing an example of one of control programs stored in the ROM 131 of FIG. 1. This program relates to an operation from the stop of power supply from the unit 18 until the data read and write operations of the memory 21. It should be noted that steps to be executed before and after the above operation are identical with those shown in FIG. 5. That is, in the step S6, the power supply from the unit 18 is stopped according to the sequence as already explained in FIG. 3. Then, in a step S11, a timer starts. If a timer count value t2 reaches a predetermined value b, i.e., if the value t2 reaches the time elapsing until a paper sheet being conveyed approaches a metallic roller (step S12), the memory 21 starts according to the procedure as already explained in FIG. 4 to read data (step S7). Then, the read data is added to the count value t2 of the print timer, and the added result is written into the memory.

Therefore, even if a charged recording paper sheet is conveyed after the high voltage applying stops, the read and write operations are performed for the nonvolatile memory 21 after the electric charge on the paper sheet is discharged by the metallic roller being operated. Thus, even if an electromagnetic noise due to the discharge is generated, it is possible to prevent that the contents of the memory 21 change due to the generated noise.

In the above-described first and second embodiments, the example that the sum of rotating time of the photosensitive drum is stored in a storage means. However, the sum of use time of other consumptive members in the process cartridge such as the charger roller 3, the toner and the like may be stored.

The present invention is not limited to the above-described embodiments, and various modifications are possible within the spirit and scope of the appended claims.

What is claimed is:

1. An image recording apparatus comprising:

generation means for generating high voltage to form an image;

access means for accessing a memory;

count means for counting a value in proportion to an image forming time in a continuous image formation operation; and control means for temporarily stopping the generation of the high voltage by said generation means when the counted value of said count means reaches a predetermined value in the middle of the continuous image formation operation, controlling said access means to cause the memory to store data in a high-voltage generation stop state, and then restarting the generation of the high voltage by said generation means.

2. An apparatus according to claim 1, wherein the memory is provided in a cartridge which is mounted on said image recording apparatus.

3. An apparatus according to claim 2, wherein said control means controls the memory to store the data which is used to detect a life of the cartridge.

4. An apparatus according to claim 3, wherein the data used to detect the life is data representing the number of image formations or a use time of the cartridge.

5. An apparatus according to claim 1, wherein said control means stops image formation during the state of stopping to generate the high voltage.

6. An image recording apparatus capable of mounting a cartridge having a memory, comprising:

conveying means for conveying recording paper sheets;

count means for counting a value in proportion to a use time of the cartridge;

supply means for supplying power to the cartridge to form an image; and control means for causing said conveying means to stop the conveying of a new recording paper sheet and said supply means to stop the supplying, storing data in the memory, and then restarting operations of said conveying means and said supply means, when the counted value by said count mean s reaches a predetermined value in the middle of a continuous printing operation.

7. An apparatus according to claim 6, wherein said control means stores data used to detect a life of the cartridge, into the memory.

8. An apparatus according to claim 7, wherein the data used to detect the life is data representing the number of image formations.

9. An apparatus according to claim 7, wherein the cartridge has a photosensitive drum and the data used to detect the life is data representing a rotating time of the photosensitive drum.

10. A control method of an image recording apparatus, sa id method comprising:

a generation step of generating high voltage to form an image;

a count step of counting a value in proportion to an image forming time in a continuous image formation operation;

a stop step of temporarily stopping the generation of the high voltage in said generation step when the counted value in said count step reaches a predetermined value in the middle of the continuous image formation operation;

a storage step of storing data into a memory in a state of stopping to generate the high voltage; and a restart step of restarting the generation of the high voltage in said generation step after storing the data.

11. A method according to claim 10, wherein the memory is provided in a cartridge which is mounted on the image recording apparatus.

12. A method according to claim 11, wherein data used to detect a life of the cartridge is stored in the memory in said storage step.

13. A method according to claim 12, wherein the data used to detect the life is data representing the number of image formations or a use time of the cartridge.

14. A control method of an image recording apparatus capable of mounting a cartridge having a memory, said method comprising:

a conveying step of conveying recording paper sheets;

a count step of counting a value in proportion to a use time of the cartridge;

a supply step of supplying power to the cartridge to form an image;

a stop step of stopping a conveying operation of a new recording paper sheet in said conveying step and a supplying operation of the power in said supply step when the counted value in said count step reaches a predetermined value in the middle of a continuous printing operation;

a storage step of storing data in the memory in a state of stopping the conveying operation and the supplying operation; and a restart step of restarting the conveying operation in said conveying step and the supplying operation in said supply step after storing the data.

15. A method according to claim 14, wherein data used to detect a life of the cartridge is stored in the memory in said storage step.

16. A method according to claim 15, wherein the data used to detect the life is data representing the number of image formations.

17. A method according to claim 15, wherein the cartridge has a photosensitive drum and the data used to detect the life is data representing a rotating time of the photosensitive drum.

18. An image recording apparatus, which accepts a printing request from an external apparatus, comprising:

mounting means capable of mounting a process cartridge having a memory;

control means for performing a predetermined operation including an access to said memory, in a state that the process cartridge is being mounted; and notification means for notifying, when the predetermined operation including the access to said memory is performed by said control means, said external apparatus that said image recording apparatus is in a state different from a standby state capable of accepting the printing request from said external apparatus.

19. An apparatus according to claim 18, wherein the state different from the standby state capable of accepting the printing request from said external apparatus is a waiting state.

20. An apparatus according to claim 18, wherein the predetermined operation includes a control operation for electrophotographic process means.

21. An apparatus according to claim 20, wherein the predetermined operation includes a control operation of temporarily stopping high-voltage supply to said electrophotographic process means.

22. A n apparatus according to claim 21, further comprising driving means for rotatively driving a photosensitive member, wherein said control means temporarily stops the high-voltage supply to said electrophotographic process means in a state that said driving means is being driven.

23. A method which controls an image recording apparatus for accepting a printing request from an external apparatus, comprising:

a step of determining, in a state that a process cartridge having a memory is being mounted, to perform a predetermined operation including an access to the memory; and a step of notifying, when the predetermined operation including the access to the memory is performed, the external apparatus that the image recording apparatus is in a state different from a standby state capable of accepting the printing request from the external apparatus.

24. A method according to claim 23, wherein the state different from the standby state capable of accepting the printing request from the external apparatus is a waiting state.

25. A method according to claim 23, wherein the predetermined operation includes a control operation for electrophotographic process means.

26. A method according to claim 25, wherein the predetermined operation includes a control operation of temporarily stopping high-voltage supply to the electrophotographic process means.

27. A method according to claim 25, further comprising a driving step of rotatively driving a photosensitive member, wherein the control operation temporarily stops the high-voltage supply to the electrophotographic process means in a state that said driving step is being activated.

* * * * *

UNITED STATES PATENT AND TRADEMARK OFFICE

CERTIFICATE OF CORRECTION

PATENT NO. : 6,173,129 B1
DATED : January 9, 2001
INVENTOR(S) : Junichi Kimizuka It is certified that error appears in the above-identified patent and that said Letters Patent is hereby corrected as shown below:

Column 2,
Line 18, "FIG." should read -- FIG. 1; --.

Column 7,
Line 10, "mean s" should read -- means --;
Line 21, "sa" should be deleted; and
Line 22, "id" should read -- said --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,173,129 B1
DATED : January 9, 2001
INVENTOR(S) : Junichi Kimizuka It is certified that error appears in the above-identified patent and that said Letters Patent is hereby corrected as shown below:

Title page,
Item [54], Title, "IMAGE RECORDING APPARATUS CAPABLE OF DETECTING LIFE OF A REPLACEABLE CARTRIDGE" should read -- IMAGE RECORDING APPARATUS CAPABLE OF MOUNTING CARTRIDGE --.

Signed and Sealed this

Eighteenth Day of February, 2003

JAMES E. ROGAN
*Director of the United States Patent and Trademark Office*